United States Patent [19]

Kingsley et al.

[11] 4,027,856

[45] June 7, 1977

[54] FENCE POST ASSEMBLY

[75] Inventors: Ernest James Kingsley; Horst Guenter Mendgen, both of West Vancouver, Canada

[73] Assignee: Zygon Industries Limited, Vancouver, Canada

[22] Filed: Aug. 18, 1975

[21] Appl. No.: 605,269

[52] U.S. Cl. ..... 256/47; 52/155

[51] Int. Cl.[2] ..... B21F 27/00

[58] Field of Search ..... 256/47; 52/155, 157, 52/165; 40/145 A; 135/15 PQ

[56] References Cited

UNITED STATES PATENTS

| | | | |
|---|---|---|---|
| 200,206 | 2/1878 | Langham | 52/155 |
| 315,018 | 4/1885 | Goddu | 52/155 |
| 1,454,649 | 5/1923 | Murton | 256/47 |
| 1,530,330 | 3/1925 | Rowe | 256/47 |
| 2,206,625 | 7/1940 | Beach et al. | 52/165 |
| 3,498,588 | 3/1970 | Turner, Jr. | 256/47 |

*Primary Examiner*—Werner H. Schroeder

*Assistant Examiner*—Doris L. Troutman

*Attorney, Agent, or Firm*—Carver and Company

[57] ABSTRACT

Fence post assembly including generally Y sectioned post with V sectioned anchor plate secured to post at lower end thereof. When the V sectioned anchor plate is embedded in soil, it provides greater resistance to lateral movement through soil under oblique forces applied to post than prior art flat anchor plates. V-sectioned anchor plate also tends to self-stabilize plate to align it to resist movement under oblique forces. Post has three outwards extending flanges, two of which are inclined to each other to define V therebetween. Anchor plate has two wings inclined to each other at similar V so as to fit in V of post. Post has plate location means which include notches in outer edges of the two flanges. Anchor plate has connecting means for securing anchor plate to fence post, which means include complementary pair of tangs extending from wings, the tangs engaging the notches in the flanges to sandwich the flanges between tangs and wings.

10 Claims, 6 Drawing Figures

FENCE POST ASSEMBLY

BACKGROUND OF THE INVENTION

1. Field of the Invention

The invention relates to a fence post assembly particularly adapted for, but not limited to, use in agricultural applications.

2. Prior Art

Fence posts for agricultural applications are commonly made of steel and are usually supplied with an anchor plate secured at the lower end thereof. Common fence posts are generally T sectioned, and the anchor plate is generally flat and is secured against aligned flanges of the post so as to be parallel to the aligned flanges. When the post is driven into soil, area of the anchor plate bearing against the soil is considerably greater than area of the aligned flanges and thus the plate increases resistance to lateral movement of the lower end of the post through the soil. The flat anchor plate offers considerable resistance only to lateral forces applied to the post generally normally to the plate, and if the lateral forces are disposed obliquely at a shallow angle to the plate, or parallel to the plate, the plate offers little or no increase in resistance over a post without an anchor plate. Because the flat anchor plate provides resistance to lateral movement only in a fairly limited range of angles, it is limited in its application and such anchor plates are not acceptable to all farmers.

Y sectioned fence posts are also known, but these are normally supplied with a flat anchor plate also and suffer from similar limitations relating to oblique lateral forces on the plate. Commonly there are difficulties in securing a flat anchor plate to a Y sectioned post, which results in a relatively costly fence post assembly.

SUMMARY OF THE INVENTION

The invention reduces difficulties of the prior art by providing a Y sectioned fence post assembly with a V sectioned anchor plate at the lower end thereof. The anchor plate has a section complementary to a portion of the post and thus facilitates securing of the plate to the post. The V section also provides a resistance to lateral movement of the lower end of the post over a wider range of angles than that attainable with a flat anchor plate of the prior art.

A fence post assembly according to the invention includes an elongated, generally Y sectioned post having first, second and third flanges extending from an inner core portion of the post. The first and second flanges are inclined to each other at a main angle to define a V therebetween. The post has anchor plate location means adjacent the lower end thereof to accept and retain the V sectioned anchor plate of the assembly. The plate has a longitudinal axis and first and second wings extending on generally opposite sides of the axis. The wings are inclined to each other at an angle generally equal to the main angle of the post so as to fit in the V defined by the first and second flanges when the longitudinal axis is generally parallel to the fence post. The anchor plate has connecting means for securing the anchor plate to the fence post and the location means prevent longitudinal movement of the plate along the post.

The location means on the fence post is characterized by the first and second flanges having outer edges, each outer edge having a notch to form a complementary pair of notches. The connecting means of the anchor plate is characterized by the first and second wings each having a tang extending therefrom to form a complementary pair of tangs, the tangs being adapted to engage the notches in the outer edges of the first and second flanges. This permits the anchor plate to be secured easily to the flanges of the post by the tangs engaging the notches, and also permits the plate to be removed easily from the post if necessary.

A detailed disclosure following, related to drawings, describes a preferred embodiment of the invention which however is capable of expression in structure other than that particularly described and illustrated.

DESCRIPTION OF THE DRAWINGS

FIGS. 1 through 5

Figure 3:
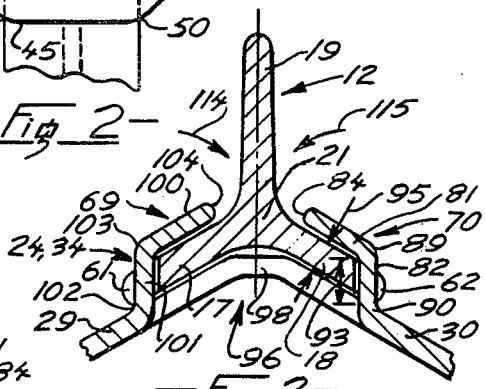
FIG. 3 is a fragmented section on Line 3—3 of FIG. 2.
Figure 4:
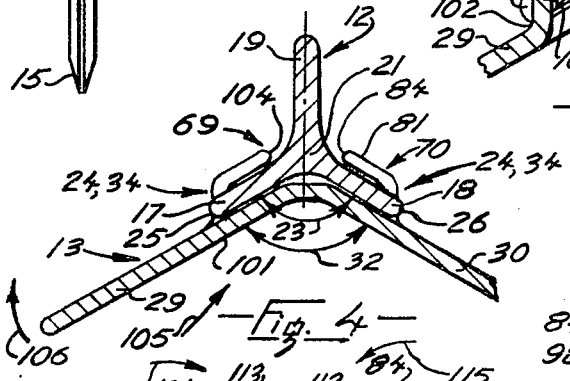
FIG. 4 is a fragmented section on Line 4—4 of FIG. 2.

A fence post assembly 10 according to the invention includes an elongated, generally Y sectioned post 12 and a V sectioned anchor plate 13 secured thereto. The post has upper and lower ends 14 and 15, the end 15 being sharpened so as to facilitate driving of the post into the ground. The anchor plate 13 is secured adjacent the lower end 15 to increase resistance of the post to lateral movement through the soil into which it is driven, surface of the soil being designated 16. Referring mainly to FIGS. 3 and 4, the post has first, second and third flanges 17, 18 and 19 extending from an inner core portion 21 of the post, the first and second flanges being inclined to each other at a main angle 23 of approximately 120 degrees to define a V therebetween. The post has anchor plate location means 24 provided on outer edges 25 and 26 of the flanges 17 and 18 adjacent the lower end of the post, so as to locate the anchor plate on the post and below the soil surface as will be described.

Figure 1:
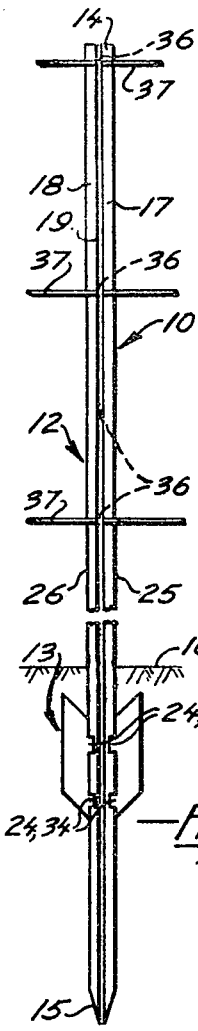
FIG. 1 is a fragmented rear elevation of a fence post assembly according to the invention, the post being embedded in soil and forming a portion of a fence.

The anchor plate 13 has a longitudinal axis 27 and first and second wings 29 and 30 extending on generally opposite sides of the axis. The wings are inclined to each other at an angle 32 which is generally equal to the main angle 23. Thus the anchor plate is shaped so as to be complementary to the post and to fit in the V defined by the first and second flanges when the longitudinal axis 27 is generally parallel to the fence post. The anchor plate has connecting means 34 for securing the anchor plate to the fence post as will be described. Referring to FIG. 1, the third flange 19 of the post has a plurality of longitudinally spaced openings 36 for retaining wires 37 to the post by conventional means, not described, so as to form a fence.

Figure 2:
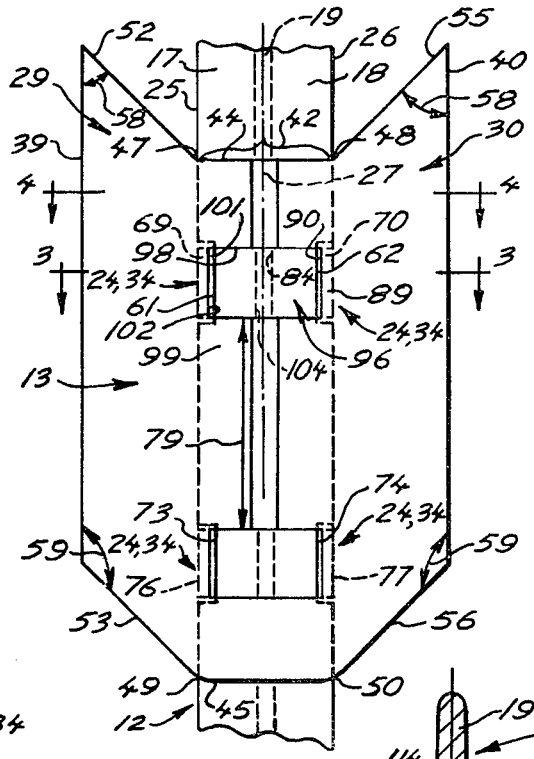
FIG. 2 is a fragmented front elevation showing an anchor plate and a portion of the post at enlarged scale.

Referring to FIG. 2, the anchor plate is characterized by side edges 39 and 40 defining in part outer portions of the wings 29 and 30, the side edges being disposed parallel to the longitudinal axis 27 of the anchor plate.

The anchor plate has a central portion 42 straddling the longitudinal axis of the plate, the central portion having upper and lower edges 44 and 45 disposed normally to the longitudinal axis 27. The upper edge 44 extends between plate inner corners 47 and 48 disposed adjacent the outer edges 25 and 26 of the first and second flanges, and the lower edge 45 extends between plate inner corners 49 and 50 also disposed adjacent edges 25 and 26. The wing 29 has upper and lower edges 52 and 53 and the wing 30 has upper and lower edges 55 and 56. The upper and lower edges of the wings are inclined upwardly from the plate inner corners of the upper and lower edges 44 and 45 respectively to intersect the side edges 39 and 40 of the wings at angles 58 and 59, which angles are approximately 45° and 135° respectively. Thus the upper and lower edges and side edges of the wings of the anchor plate provide a generally arrow-shaped anchor plate which is adapted to penetrate soil easily when the post is driven into the ground.

Referring mainly to FIGS. 2 through 4, the anchor plate location means 24 on a lower portion of the post 12 is characterized by the outer edges 25 and 26 of the flanges 17 and 18 having notches 61 and 62 to form a complementary pair of notches. The connecting means 34 of the anchor plate is characterized by the wings 29 and 30 having tangs 69 and 70 respectively extending therefrom to form a complementary pair of spaced tangs, the tangs being adapted to engage the notches 61 and 62 respectively in the outer edges of the first and second flanges. As seen in FIG. 2, the edges 25 and 26 have second notches 73 and 74 respectively, and the first and second wings 29 and 30 have second tangs 76 and 77 respectively, the four tangs being shown in broken outline. Thus the edge of the first flange has two axially spaced notches, each notch being aligned transversely with a respective complementary notch on the edge of the second flange, and the first wing has two axially spaced tangs, each tang being aligned transversely with a respective corresponding tang of the second wing. The tangs of each wing are spaced apart longitudinally at an axial spacing 79 which is generally equal to axial spacing of the notches on the post. Thus the tangs of the first and second wings can be aligned and fitted in the notches on the edges of the first and second flanges respectively of the post, so that the anchor plate is secured to the flanges by the tangs engaging the notches and the flanges, and the plate is prevented from moving axially relative to the post as it is driven in the ground.

Figure 5:
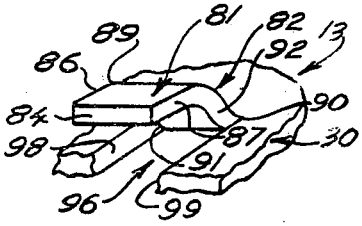
FIG. 5 is a fragmented perspective of a tang and adjacent portions of the anchor plate.

Referring mainly to FIGS. 3 and 5, the tang 70 has a tab portion 81, and a step portion 82. The tab portion 81 is defined by an inner edge 84 and a pair of spaced side edges 86 and 87 extending outwards from the inner edge to an outer fold 89. The inner edge of the tab portion is generally parallel to the longitudinal axis 27 of the plate and is disposed normally to the side edges of the tab portion. The step portion 82 is defined by the outer fold 89 and spaced side edges 91 and 92 extending from the outer fold to an inner fold 90. The step portion has a width 93 defined as space between the inner and outer folds 90 and 89, which space is somewhat greater than thickness 95 of the flange 18. The notch has a size, i.e. is of sufficient length, to accept the step portion as seen in FIG. 2. The tab portion extends inwards from the step portion towards the longitudinal axis of the plate and is disposed generally parallel to the adjacent wing 30, and is spaced from the wing 30 as a distance generally equal to the thickness 95.

As seen in FIGS. 3 and 4, the tang 69 is a mirror image of the tang 70 on an opposite side of the longitudnal axis 27, and similarly has a tab portion 100, a step portion 101, inner and outer folds 102 and 103 and an inner edge 104. When the tangs are fitted to secure the anchor plate to the post, the step portion of each tang is accepted in the notch of the adjacent flanges of the post, and the flange is effectively sandwiched between the tab portion and an adjacent portion of the wing of the anchor plate.

The V sectioned anchor plate has a particular advantage relating to stability of the plate in the ground when compared with a prior art flat anchor plate in which wings of the plate are disposed within a single plane. A V sectioned anchor plate has wings disposed in two planes and thus has a greater chance of one wing being generally normal to a force applied to the post than if the plate were flat. This would inherently increase resistance to movement over a wider range of angles of forces applied to the post when compared with the prior art flat plate. The discussion following assumes that the post subjected to the force remains generally vertical and does not lean over excessively. Referring to FIG. 4, if a force were applied on the post in direction of an arrow 105, i.e. not aligned with the third flange 19, it is noted that projected area of the wing 30 in direction of the force is greater than projected area of the wing 29. Thus, other factors being equal, the wing 30 would offer greater resistance to movement through the soil than the wing 29, which would therefore tend to move laterally through the soil before the wing 30 moved.Thus, assuming that the post and wing can move laterally, the wing 30 would act similarly to a fulcrum and the post and wing 29 would tend to swing about the wing 30 in direction of an arrow 106. As the swing of the wing 29 progressed, the wing 29 would present an increasing projected area to bear against the soil, which increase in area would eventually tend to stop further swinging. Thus, in some conditions when the post is embedded in particularly mobile soil or sand, the V sectioned plate may rotate slightly to stabilize the lower end of the post against relatively oblique forces, that is forces inclined at an angle to the plate other than generally aligned with the third flange 19.

Thus, it can be seen that the anchor plate moves in an attempt to present equal projected areas of wings to resist further movement and thus is self-stabilizing. It can be seen that the angled wings of the plate function similarly to dihedral of aircraft wings which provides stability against roll of the aircraft. The angle 120 degrees is selected for convenience of the Y sectioned post, however other obtuse angles would serve similarly. For convenience of fitting, the angle between the wings is generally equal to the main angle between the flanges.

MANUFACTURE AND FITTING, WITH REFERENCE ALSO TO FIG. 6.

Figure 6:
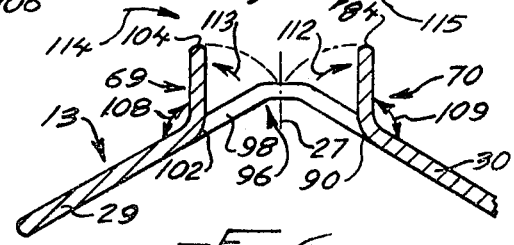
FIG. 6 is a transverse section generally on Line 3—3 of FIG. 2 through connecting means of the anchor plate prior to securing the anchor plate to the post.

The anchor plate is sheared and formed from a suitable thickness of sheet steel, for example about 12 gauge steel (0.0146 inch). The complementary pair of tangs 69 and 70 are sheared simultaneously from the anchor plate so that a portion of the anchor plate between the tangs has an opening 96 defined by side edges 98 and 99 and the inner folds 90 and 102 of the tangs 70 and 69, the side edges of the opening being complementary to the side edges of the respective tangs. Referring to FIG. 6 only, the tangs 69 and 70 are shown in an initial position following the shearing and forming of the inner folds. The inner edges 84 and 104 of the tangs 70 and 69 were sheared from a position adjacent the axis 27 of the plate, and the tangs were then bent upwards in directions of arrows 112 and 113. For fitting the plate to the post the tangs 69 and 70 initially extend at angles 108 and 109, approximately 120 degrees, to the adjacent wings. The post is positioned so that the tangs engage the respective notches and the tangs 69 and 70 are then bent inwards in direction of the arrows 114 and 115 to form the outer folds 89 and 103.

Thus, it can be seen that the anchor plate can be easily sheared from sheet material and can be formed to engage the notches at the sides of the post. The tab portions are then pressed down so as to locate the anchor plate securely on the post, preventing longitudinal movement along the post and rotation relative to the post. This method of securing is thus economical, is adaptable to mass production methods, and with simple tools permits easy removal and replacement of the anchor plate from the post. Furthermore the post is not weakened materially by the notches which are relatively shallow when compared to width of the flange.

We claim:

1. A fence post assembly including:

i. an elongated, generally Y sectioned post having first, second and third flanges extending from an inner core portion of the post, the first and second flanges having outer edges and being inclined to each other at a main angle to define a V therebetween, each outer edge having two longitudinally spaced notches, ii. a V sectioned anchor plate having a longitudinal axis and first and second wings, the wings extending on generally opposite sides of the axis and being inclined to each other at an angle generally equal to the main angle of the post so as to fit in the V defined by the first and second flanges when the longitudinal axis is generally parallel to the fence post, the first and second wings each having a pair of tangs extending therefrom and spaced apart longitudinally at an axial spacing equal to axial spacing of the respective notches on the post, the tangs being adapted to engage respective notches in the outer edges of the flanges, so that the anchor plate is secured to the post by the tangs which engage the notches in the flanges and essentially prevent the plate from moving axially relative to the post.

2. A fence post assembly as claimed in claim 1 in which:

i. each notch on the first flange is aligned transversely with a complementary notch on the second flange to form two pairs of complementary notches, ii. each tang of the first wing is aligned transversely with a respective complementary tang of the second wing to form two complementary pairs of tangs.

3. A fence post assembly as claimed in claim 2 in which: p1 i. the main angle defined by the first and second flanges of the post is approximately 120°.

4. A fence post assembly as claimed in claim 2 in which:

(i). each tang has a tab portion and a step portion, the tab portion being defined by an inner edge generally adjacent the longitudinal axis of the anchor plate, and a pair of spaced side edges extending outwards from the inner edge to an outer fold; the step portion being defined by the outer fold and spaced side edges extending from the outer fold to an inner fold adjacent the wing, the step portion having a width defined by space between the inner and outer folds which width is somewhat greater than thickness of the flange of the post, the tab portion extending inwards from the step portion towards the longitudinal axis of the plate and being disposed generally parallel to the adjacent wing, and spaced from the adjacent wing a distance generally equal to the thickness of the flange, ii. the notch has a size to accept the step portion, so that when the step portion is accepted in the notch of the adjacent flange of the post, the flange is sandwiched between the tab portion and an adjacent portion of the wing of the anchor plate.

5. A fence post assembly as claimed in claim 4 in which:

i. each complementary pair of tangs are sheared from the anchor plate so that a portion of the anchor plate between the tangs has an opening defined by side edges and inner folds of the tangs, the side edges of the opening being complementary to the side edges of the respective tangs.

6. A fence post assembly as claimed in claim 4 in which:

i. the inner edge of each tab portion is generally parallel to the longitudinal axis of the plate and is disposed normally to the side edges of the tab portion.

7. A fence post assembly as claimed in claim 1 in which:

i. the third flange of the post has a plurality of longitudinally spaced openings for retaining wire of the fence to the post.

8. A fence post assembly as claimed in claim 1 in which:

i. the anchor plate has a central portion straddling the longitudinal axis of the plate, ii. the wings have upper and lower edges inclined upwardly from positions adjacent the central portion so as to provide a generally arrow-shaped plate.

9. A fence post assembly as claimed in claim 8 in which the anchor plate is characterized by:

i. side edges defining in part outer portions of the wings, the side edges being parallel to the longitudinal axis of the anchor plate, ii. the central portion having upper and lower edges disposed normally to the longitudinal axis of the anchor plate and extending between plate inner corners adjacent the outer edges of the first and second flanges, iii. the upper and lower edges of the wings are inclined upwardly from the plate inner corners of the upper and lower edges respectively to intersect the side edges of the wings at approximately 45° and 135° respectively.

10. A fence post assembly as claimed in claim 1 in which;

i. the main angle defined by the first and second flanges of the post is approximately 120°.

* * * * *